US007135651B2

(12) United States Patent
Lung

(10) Patent No.: US 7,135,651 B2
(45) Date of Patent: Nov. 14, 2006

(54) DETECT SWITCH WITH AN IMPROVED MOVEABLE CONTACT

(75) Inventor: Ssu-Min Lung, Tu-Chen (TW)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 11/173,376

(22) Filed: Jun. 30, 2005

(65) Prior Publication Data

US 2006/0076223 A1 Apr. 13, 2006

(30) Foreign Application Priority Data

Sep. 24, 2004 (TW) ..... 93128972 A

(51) Int. Cl.
*H01H 21/00* (2006.01)

(52) U.S. Cl. ..... 200/559; 200/16 D; 200/537; 200/557; 200/563

(58) Field of Classification Search .... 200/16 R–16 D, 200/553, 557–563, 339
See application file for complete search history.

(56) References Cited

U.S. PATENT DOCUMENTS 5,796,058 A * 8/1998 Aimi et al. ..... 200/16 D
6,222,144 B1 * 4/2001 Nishikawa ..... 200/537
6,248,966 B1 * 6/2001 Nakase et al. ..... 200/557
6,479,776 B1 * 11/2002 Nakase et al. ..... 200/559
6,525,285 B1 * 2/2003 Kudo et al. ..... 200/559
6,559,401 B1 * 5/2003 Minami et al. ..... 200/559
6,633,013 B1 * 10/2003 Nishimura et al. ..... 200/559
6,917,008 B1 * 7/2005 Ni ..... 200/563
2001/0025780 A1 10/2001 Kudo et al.

* cited by examiner

*Primary Examiner*—Michael A Friedhofer
(74) *Attorney, Agent, or Firm*—Wei Te Chung

(57) ABSTRACT

A detect switch (100) includes an insulative housing (1), a first and second fixed terminals (51, 52) retained in the insulative housing, a moveable contact (3), an operator assembly (2) and a cover (4) mounted on the insulative housing. The operator assembly (2) comprises a rotator (22) lying over the moveable contact, and an actuator (21) cooperating with the rotator (22) to drive the moveable contact. The moveable contact is formed with a pair of contacting portions (311, 321), a width of which is smaller than that of the fixed terminals. The contacting portions come to contact with and thereby electrically connect the fixed terminals when the operator assembly is manipulated.

11 Claims, 4 Drawing Sheets

DETECT SWITCH WITH AN IMPROVED MOVEABLE CONTACT

BACKGROUND OF THE INVENTION

1. Field of the Invention

The present invention relates to a switch, and particularly to a detect switch used in various electronic applications.

2. Description of the Prior Art

A conventional detect switch described in U.S. patent application Publication No. 2001/0025780 A1 comprises a case 11, a stationary contact 13, a common contact 14, a movable contact 15 retained in the case 11, and a lever 12 located above the moveable contact 15. The contacts 13, 14 are embedded in the case 11 by insert molding, with the common contact 14 being disposed in a side surface of the case 11, and the stationary contact 13 being disposed in a bottom surface of the case 11. A stationary portion 15F, a contact portion 15H, and a curved portion 15A formed therebetween are provided on the movable contact 15 which is made up of elastic metal material. The stationary portion 15F and the contact portion 15H have the same width as the contacts 13, 14. The stationary portion 15F maintains contacting with the common contact 14 in a normal state. The movable contact 15 is disposed in a state of bending so that the contact portion 15H may come in contact with or apart from the stationary contact 13. The lever 12 is formed with an operating portion 12C rotatablely received in the case 1, and a driving portion 12B abutted against by the curved portion 15A. When the operating portion 12C is rotated forward and downwardly by an exerted force exerted thereon, the driving portion 12B pushes the curved portion 15A downwardly, thus to make the contact portion 15H slide forward to come in contact with the stationary contact 13.

When the switch is manufactured, during the process of making the contacts 13, 14 embedded in the case 11 by insert molding, it is easy to produce something hairlike which would prevent the contact portion 15H coming in contact with the stationary contact 13 smoothly and availably. As a result, it is hard to establish a reliable electrical connection between the contacts 13, 14.

Hence, an improved switch having an improved moveable contact to overcome the above-mentioned disadvantages of the prior art will be described in detail in the following embodiments.

BRIEF SUMMARY OF THE INVENTION

A primary object of the present invention is to provide a detect switch with an improved moveable contact.

To achieve the aforementioned objects, a detect switch corresponding to the present invention comprises an insulative housing, a first and second fixed terminals retained in the insulative housing, a moveable contact, an operator assembly and a cover mounted on the insulative housing. The insulative housing defines thereon a first, second slot for receiving the fixed terminals. The operator assembly comprises a rotator lying over the moveable contact, and an actuator cooperating with the rotator and urging the rotator to drive the moveable contact. Each terminal has a fixed contact disposed in said insulative housing. The moveable contact is formed with a pair of contacting portions, a width of which is smaller than that of the fixed terminals. The contacting portions come to contact with and thereby electrically connect the fixed terminals when the operator assembly is manipulated.

It is available to make the fixed terminals embedded in the insulative housing firmly because of an engagement among the first slot, the second slot and the fixed terminals. At the same time, since the fixed terminals are fixed firmly in the insulative housing, it would be harder to produce something hairlike at an outer surface of the fixed terminals during the process of manufacturing the same. The contacting portions are designed with a width smaller than that of the fixed terminals. The contacting area between the contacting portions and the corresponding fixed terminals would be reduced. It would be more durable for the contacting portions to avoid an interference of something hairlike when the contacting portions move away from the fixed terminals. Thus it would be smoothly and available for the contacting portions to return to a normal state.

Other objects, advantages and novel features of the invention will become more apparent from the following detailed description of a preferred embodiment when taken in conjunction with the accompanying drawings.

DETAILED DESCRIPTION OF THE PREFERRED EMBODIMENTS

Figure 1:
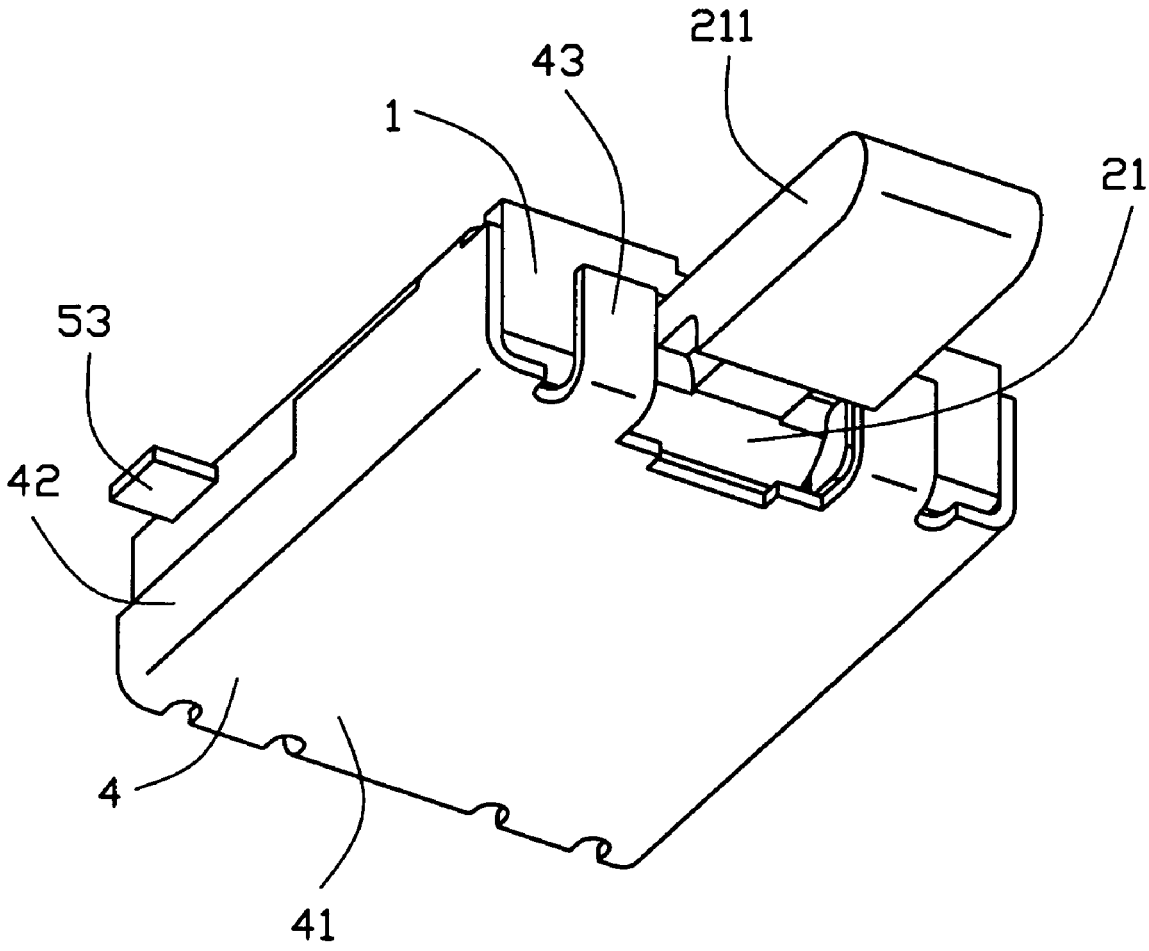
FIG. 1 is a perspective view of a detect switch according to the present invention.
Figure 2:
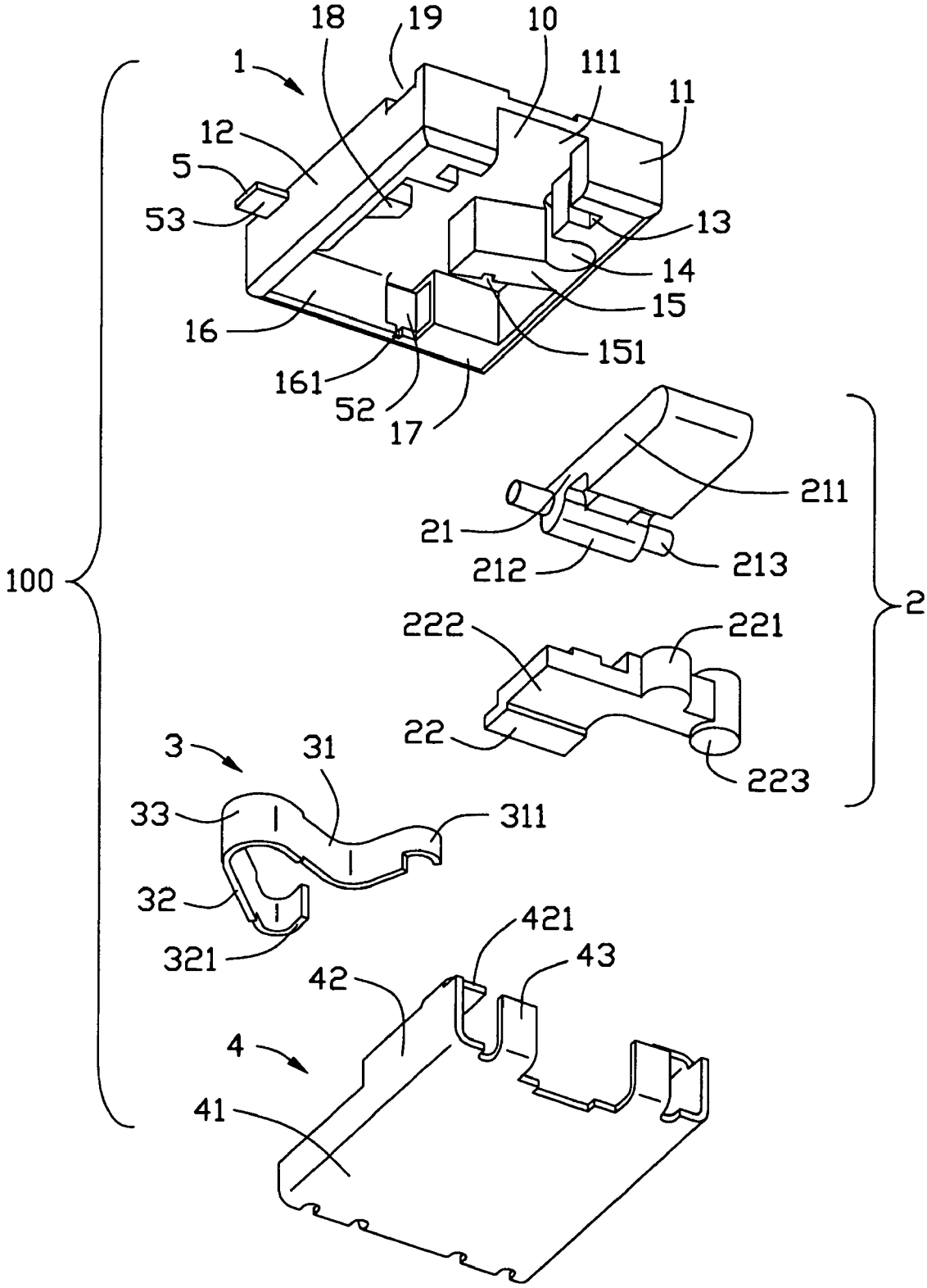
FIG. 2 is an exploded view of FIG. 1.
Figure 3:
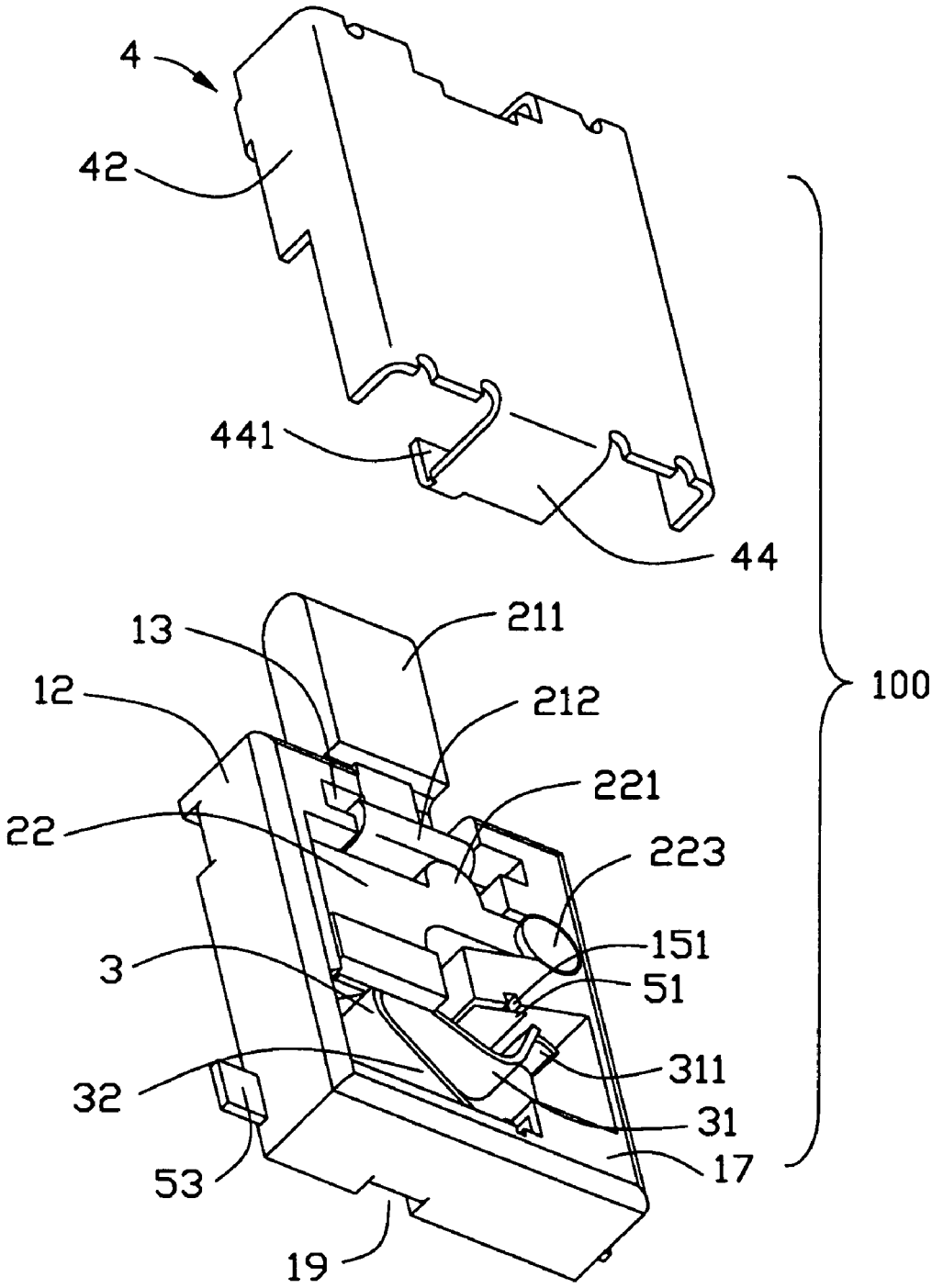
FIG. 3 is a partially exploded view of the detect switch.
Figure 4:
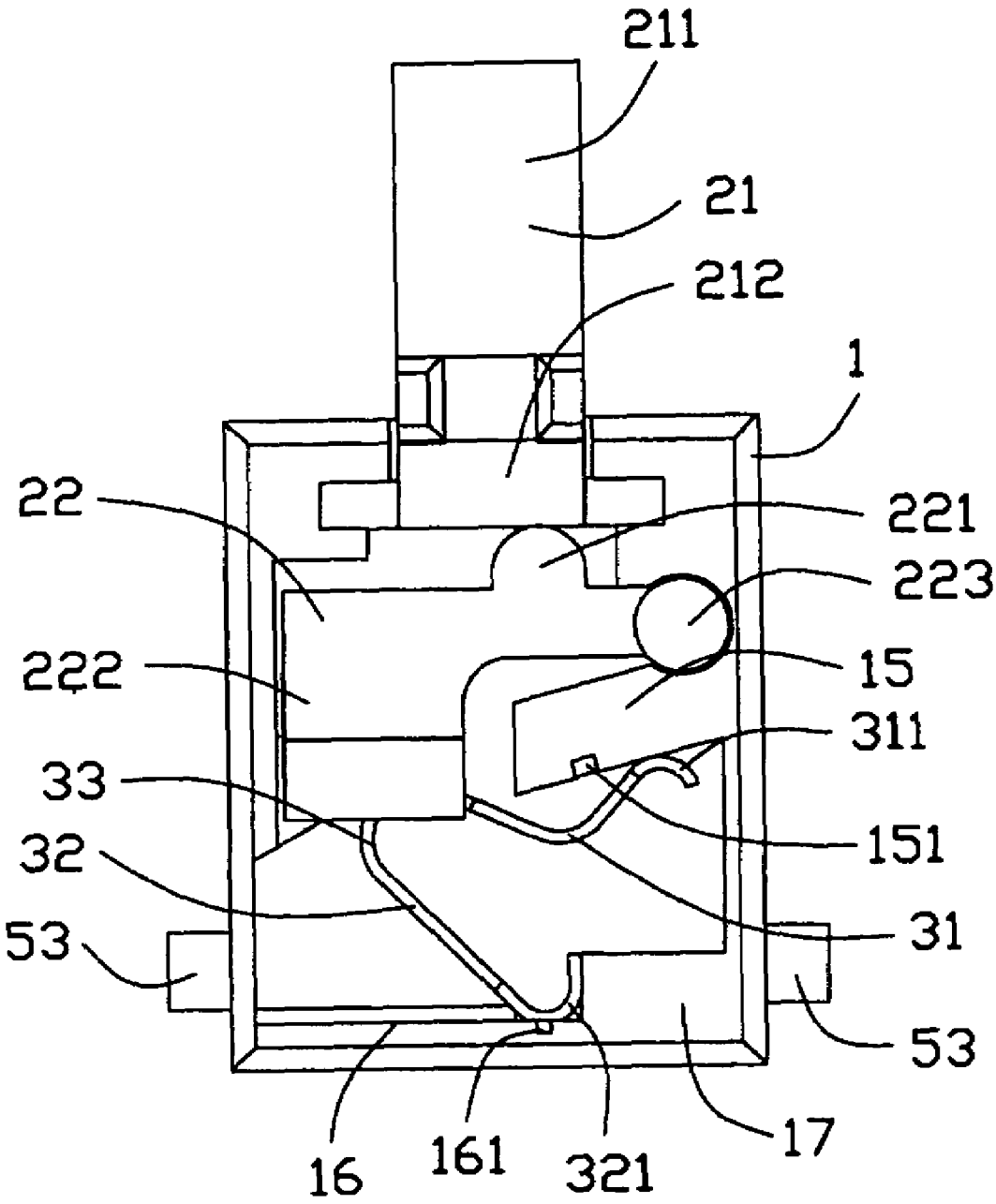
FIG. 4 is a top view of the detect switch with the cover being removed.

Referring to FIGS. 1–4, a detect switch 100 according to the present invention comprises an insulative housing 1, a pair of fixed terminals 5, a moveable contact 3, an operator assembly 2 and a cover 4.

The insulative housing 1 is formed as a substantially rectangular case, and comprises a base 10, a bottom wall 16 defining a second slot 161 in an inner surface thereof, a top wall 11 opposed to the bottom wall 16 and a pair of periphery walls 12 extending forward from opposite sides of the base 10. The base 10 and the walls 16, 11, 12 cooperate to define a cavity (not labeled) for receiving the moveable contact 3 and the operator assembly 2. The top wall 11 defines a cutout 11 in a central portion thereof corresponding to the operator assembly 2. The cavity defines a pair of receiving recesses 13 therein, wherein the pair of receiving recesses 13 are symmetrically arranged adjacent to the periphery walls 12 in a transverse direction. The periphery walls 12 respectively has a projection 15 and a tuber 18 thinner than the periphery wall 12 protruding toward the cavity from a pair of opposite inner surface thereof. The projection 15 defines a first slot 151 at a lower surface thereof. Moreover, a circular mounting hole 14 is defined between the receiving recess 13 and the projection 15. The insulative housing 1 has a nose portion 17 located at a corner portion thereof adjacent to the projection 15. A plurality of engaging holes 19 are defined at a rear surface of the base 10.

The pair of fixed terminals 5 are embedded in the insulative housing 1 by insert molding and include a first and second fixed terminals 51, 52. The first fixed terminal 51 is partly exposed at the lower surface of the projection 15 and engages with the first slot 151. The second fixed contact 52 is embedded in the bottom wall 16 and partly exposed at the upper surface thereof. Each fixed terminal 5 has a soldering portions 53 extending throughout the insulative housing 1.

The moveable contact 3 made of flexible conductive material is disposed in a state of bending. The moveable contact 3 comprises a U-shaped curved portion 33, a V-shaped sliding arm 31 extending laterally from one end of the curved portion 33, and a stationary arm 32 formed at the other end of the curved portion 33. A sliding contact portion 311, a stationary contact portion 321 are respectively formed at a free end of the sliding arm 31, the stationary arm 32. The contact portions 311, 321 are respectively provided with a semi-circular curvature surface for sliding agilely. The sliding contact portion 311 and the stationary contact portion 321 respectively have a width smaller than that of the fixed terminals 51, 52 and arms 31, 32.

The operator assembly 2 comprises an actuator 21 partly received in the insulative housing 1 via the cutout 10, and a rotator 22 complying with the actuator 21. The actuator 21 is rotatablely retained in the cavity of the insulative housing 1 and includes a manipulating section 211 with a substantially rectangular shape, a columnar driving portion 212, and an axle portion 213 mounted throughout the driving portion 212 in a transverse direction with a pair of free ends adapted to be retained in the receiving recesses 13. The rotator 22 comprises a L-shaped board portion 222, a protrusion 221, and a pivot 223 rotatably retained in the mounting hole 14. The protrusion 221 projects upwardly from a top of the board portion 222 with an upper surface formed as a semi-circular curvature surface engaging with an outer surface of the driving portion 212. The pivot 223 in a shape of columnar is arranged perpendicular to the driving portion 212. The board portion 222 is capable of rotating around the pivot 223 or converting to be reversed.

The detect switch is further provided with a cover 4. The cover 4 comprises a body portion 41, a pair of periphery beams 42 extending rearwardly from a pair of parallel edges of the board portion 41, a pair of top beams 43 and a bottom beam 44 respectively formed at another pair of the parallel edges of the board portion 41. The periphery beams 42, top beams 43, and the bottom beam 44 respectively clasps the periphery walls 12, top wall 11, and the bottom wall 16 of the insulative housing 1. The pair of periphery beams 42 and the rear beam 44 respectively has an engaging potion 421, 441 formed thereon with a free end adapted to be inserted into the engaging holes 19.

In assembly, the moveable contact 3 is received in the cavity of the insulative housing 1, with the curved portion 33 standing against the tuber 18. The sliding contact portion 311 lies over the lower portion of the projection 15 and disengages with the first terminal 51. At the same time, the stationary contact portion 321 abutting against the nose portion 17 keeps contact with the second terminal 52. The operator assembly 2 is received in the insulative housing 1, wherein the rotator 22 is abutted against by the moveable contact 3, and the actuator 21 is located above the rotator 22. The rotator 22 lies over the moveable contact 3 with the pivot 223 rotatably retained in the mounting hole 14. The lower portion of the board portion 222 is located before the tuber 18 and above the curved portion 33. The actuator 21 is positioned above the rotator 22, with the axle portion 213 rotatable retained in the receiving recesses 13, and the manipulating portion 211 extending throughout the cutout 111. The driving portion 212 is capable of rotating around the axle portion 213 and coupling with the protrusion 221 when an external force is exerted on the manipulating portion 211. The cover is mounted on the insulative housing 1, wherein the top beam 42, bottom beam 44 and periphery beams 43 respectively clasps the corresponding walls 11, 16, 12, with the engaging portions 421, 441 inserted into the corresponding engaging holes 19.

In operation, when the manipulating portion 211 pivots forward and downwardly around the axle portion 213 by an exerted force exerted thereon, the rotator 22 is driven to rotate around the pivot 223 thereby to depress the moveable contact 3 downwardly due to the engagement between the protrusion 221 and the driving portion 212. The sliding contact portion 311 is driven to slide backwardly to come into contact with the first fixed terminal 51, thus an electrical connection between the pair of fixed terminals 5 is established. When the exerted force is removed, the moveable contact 3 restores itself to a normal state, with the sliding contact portion 311 moving away from the first fixed terminal 51, thus the connection between the fixed terminals 5 is broken.

It will be understood that the invention may be embodied in other specific forms without departing from the spirit or central characteristics thereof. The present examples and embodiments, therefore, are to be considered in all respects as illustrative and not restrictive, and the invention is not be limited to the details given herein.

I claim:

1. A detect switch comprising:

an insulative housing comprising a base, a bottom wall and a plurality of periphery walls extending forward from said base;

first and second fixed terminals retained in said insulative housing;

a moveable contact formed with a pair of contacting portions being contactable to the two fixed terminals, each contacting portion being designed with & width smaller than a width of said first and second fixed terminals;

an operator assembly comprising a rotator lying over the moveable contact, and an actuator cooperating with said rotator for urging said rotator a to drive said moveable contact; and a cover mounted on the insulative housing;

wherein a projection projects inwardly from one of said periphery wall, and has a first slot defined on a bottom surface thereof for receiving said first fixed terminal.

2. The detect switch as described in claim 1, wherein said moveable contact comprises a curved portion, a stationary arm extending from one end of the curved portion, a sliding arm extending from the other end of the curved portion, a stationary contacting portion formed at a free end of the stationary arm and a sliding contacting portion formed at a free end of the sliding arm.

3. The detect switch as described in claim 2, wherein said stationary contacting portion and said sliding portion respectively have a width smaller than a width of said stationary arm and said sliding arm.

4. The detect switch as described in claim 3, wherein said sliding contacting portion is positioned beside said first fixed terminal, and comes to contact with said first fixed terminal and thereby electrically connect said first and second fixed terminals when said operator assembly is manipulated.

5. The detect switch as described in claim 1, wherein said bottom wall has a second slot defined thereon for receiving said second fixed terminal.

6. The detect switch as described in claim 1, wherein said insulative housing further defines a mounting hole therein, and said rotator has a columnar pivot rotatably retained in said mounting hole.

7. The detect switch as described in claim 1, wherein a pair of receiving recesses are symmetrically defined adjacent to said periphery walls, and said actuator has an axle portion retained in said receiving recesses.

8. The detect switch as claimed in claim 1, wherein a periphery wall opposed to said bottom wall defines thereon a cutout and said actuator has a manipulating section partly received in said insulative housing via said cutout.

9. The detect switch as claimed in claim 1, wherein said rotator further comprises a board potion and a protrusion projecting upwardly from a top of the board portion, and said actuator has a driving portion cooperating with said protrusion.

10. The detect switch as claimed in claim 1, wherein said cover has a body portion and at least a beam extending rearwardly from said body portion for clasping said insulative housing.

11. A detect switch comprising:

an insulative housing;

a fixed terminal retained in said insulative housing via an insert molding process with a slot formed in the housing behind the fixed terminal;

a moveable contact formed with a contacting portion being contactable to the fixed terminal, the contacting portion being designed with a width smaller than a width of said fixed terminal;

an operator assembly disposed in the housing to drive said moveable contact to have the contacting portion engaged with the fixed terminal; and a cover mounted on the insulative housing.

* * * * *